US009010056B2

(12) United States Patent
Ben David

(10) Patent No.: US 9,010,056 B2
(45) Date of Patent: Apr. 21, 2015

(54) ASSEMBLY FOR SECURING TWO JUXTAPOSED PANELS TO A STRUCTURE SO AS TO ALLOW THERMAL EXPANSION AND CONTRACTION

(75) Inventor: Micha Ben David, Upper Galilee (IL)

(73) Assignee: Dan-Pal, Upper Galilee (IL)

( * ) Notice: Subject to any disclaimer, the term of this patent is extended or adjusted under 35 U.S.C. 154(b) by 0 days.

(21) Appl. No.: 14/127,064

(22) PCT Filed: Jun. 21, 2012

(86) PCT No.: PCT/IL2012/050215

§ 371 (c)(1),
(2), (4) Date: Dec. 17, 2013

(87) PCT Pub. No.: WO2012/176207

PCT Pub. Date: Dec. 27, 2012

(65) Prior Publication Data

US 2014/0112698 A1 Apr. 24, 2014

(30) Foreign Application Priority Data

Jun. 21, 2011 (IL) ..... 213693

(51) Int. Cl.
*E04C 3/00* (2006.01)
*E04B 1/41* (2006.01)
(Continued)

(52) U.S. Cl.
CPC . *E04B 1/40* (2013.01); *E04C 2/543* (2013.01); *E04D 3/28* (2013.01); *E04D 2003/285* (2013.01); *E04B 1/61* (2013.01); *E04D 2003/3615* (2013.01)

(58) Field of Classification Search
CPC ..... E04D 1/34; E04D 1/36; E04D 13/03; E04B 2/14; E04B 9/00; E04B 1/34; E04B 1/38; E04B 3/54; E04B 7/18; E04C 3/00; E04C 2/38; E04C 5/00
USPC ..... 52/582.1, 582.2, 584.1, 588.1, 52/459–466, 469–471, 57, 395
See application file for complete search history.

(56) References Cited

U.S. PATENT DOCUMENTS 6,164,024 A 12/2000 Konstantin
6,536,175 B2 * 3/2003 Conterno ..... 52/489.1
(Continued)

FOREIGN PATENT DOCUMENTS

DE 203 09 516 9/2003
EP 949390 1/1999
(Continued)

OTHER PUBLICATIONS

International Preliminary Report on Patentability mailed Sep. 20, 2013 in PCT/IL2012/050215.

*Primary Examiner* — Beth Stephan
(74) *Attorney, Agent, or Firm* — Smith, Gambrell & Russell, LLP

(57) ABSTRACT

An assembly (10) secures to a structure (80) a panel or two juxtaposed panels (11, 12) each having a joining flange (15) in association with an edge thereof defining a longitudinal axis of the panel. The joining flanges are fastened by at least one securing element (16) that may include or have associated therewith a respective retaining member (30). For each securing element (16), a respective support element (20) is fixedly mounted to the structure and configured for slidably supporting the panels in a direction parallel to the longitudinal axis. Each support element (20) supports opposing side walls (22, 23) forming a channel (24) dimensioned for free sliding therein of the respective securing element (16) or associated retaining member, and each panel is supported by the at least one securing element without applying lateral pressure to the side walls (22, 23) of the respective support element (20).

29 Claims, 7 Drawing Sheets

(51) Int. Cl.

| | |
|---|---|
| ***E04C 2/54*** | (2006.01) |
| ***E04D 3/28*** | (2006.01) |
| ***E04B 1/61*** | (2006.01) |
| *E04D 3/361* | (2006.01) |

(56) References Cited

U.S. PATENT DOCUMENTS

| | | | | |
|---|---|---|---|---|
| 7,562,504 | B2 * | 7/2009 | Herbst et al. | 52/461 |
| 8,056,289 | B1 * | 11/2011 | Konstantin | 52/204.591 |
| 8,316,009 | B2 | 11/2012 | Fraser et al. | |
| 2003/0188500 | A1 * | 10/2003 | Voegele | 52/466 |
| 2005/0102943 | A1 | 5/2005 | Voegele, Jr. | |
| 2007/0033893 | A1 * | 2/2007 | Voegele, Jr. | 52/466 |
| 2008/0053026 | A1 * | 3/2008 | Voegele, Jr. | 52/582.1 |
| 2009/0049770 | A1 * | 2/2009 | Konstantin | 52/200 |
| 2010/0126099 | A1 * | 5/2010 | Ben-Zvi | 52/582.1 |
| 2010/0132293 | A1 | 6/2010 | Voegele, Jr. et al. | |
| 2010/0242397 | A1 * | 9/2010 | Givoni et al. | 52/588.1 |
| 2011/0225926 | A1 * | 9/2011 | Conterno | 52/782.1 |
| 2012/0151867 | A1 * | 6/2012 | Smith et al. | 52/588.1 |

FOREIGN PATENT DOCUMENTS

| | | |
|---|---|---|
| EP | 1 111 153 | 6/2001 |
| WO | 2008-149344 | 12/2008 |

* cited by examiner

ASSEMBLY FOR SECURING TWO JUXTAPOSED PANELS TO A STRUCTURE SO AS TO ALLOW THERMAL EXPANSION AND CONTRACTION

FIELD OF THE INVENTION

The present invention relates to extruded, modular panel units for the construction of walls, ceilings, roofs, canopies and windows, particularly of light-transmitting wall sections. More particularly, the present invention relates to assemblies for constructing such walls, ceilings, roofs, canopies and windows from a plurality of units while allowing for thermal expansion of the panels.

BACKGROUND OF THE INVENTION

EP 949 390 discloses two generally co-planar panels supported almost edge-to-edge by an intermediate beam. A coupling member is captive to the beam by inter-engaging longitudinal formations and provides an interlocking engagement for the edges of the panels. Opposite the coupling member the beam is proud of the panels and receives and retains a cap which seals against the panels. Downwardly directed wings in the cap engage upwardly directed channels in a base thereof and prevent side walls of the cap from splaying apart.

WO 2008/149344 in the name of the present Applicant discloses an assembly for securing to a structure two juxtaposed panels, each including a first surface, an opposing second surface and a joining flange located at, or adjacent to, respective juxtaposed edges thereof. The assembly is particularly configured to prevent splaying apart of the juxtaposed panels under load and employs a retaining member that is fixedly mounted to the support structure and to which there is attached a clamping member having two spaced-apart legs depending from a web, each leg being configured to engage a respective exposed surface of an adjacent joining flange. A fastening means is provided for fastening the retaining member to a construction element that inhibits angular displacement of the panels when force is applied to either the first or second surfaces thereof.

U.S. Pat. No. 6,164,024 discloses a light transmissive glazing panel system for overhead roof constructions where glazing panels are supported on a framework and include upstanding seam flanges for connecting adjacent panels together with a joining connector. FIGS. 4 and 13 show arrangements where panels having upwardly projecting flanges on their mating edges are juxtaposed on opposite sides of aluminum support brackets that are bolted to the roof structure and a clamping member is then disposed on the projecting flanges to secure and seal the structure.

The above publications are typical of prior art that discloses the mounting of extruded panels to a construction element. The linear coefficient of thermal expansion ($\alpha$) of polycarbonate at 23° C. is $65\text{-}70\times10^{-6}/°$ C., which is approximately three times that of aluminum for which $\alpha$ at 20° C. is $23\times10^{-6}/°$ C. To the extent that some kind of retaining member is fixedly mounted to the construction element, it is to be understood that this is incapable of movement. But the polycarbonate panels mounted thereto do expand and contract, thus becoming subject to tensile and compressive forces. Specifically, adjacent panels that expand will push against each other laterally, thus subjecting their respective mounts to compressive forces. This gives rise to high frictional forces between the panels and the mounts, which militates against thermal expansion of the panels in the longitudinal direction, which can cause buckling or other distortion of the panels.

Normally the clamping members are formed of the same or similar material to the panels, e.g. polycarbonate, such that the clamping members tend to expand at the same rate as the panels. Therefore in structures such as shown in FIGS. 7, 8 and 11 of WO 2008/149344 where the clamping members are fixedly mounted to the support structure, and are thus restrained from expanding, the panels being tightly clamped by the clamping member are likewise unable to expand.

U.S. Pat. No. 6,536,175 discloses a panel assembly and joining elements having reciprocally engaged inclined surfaces facing inwards. FIG. 7 of this patent discloses a polycarbonate jointing element fastened to a metal plate in the form of a track for connection to load bearing structures. However, the arrangement is not directed to the need to allow for longitudinal thermal expansion. Moreover, in order to ensure a waterproof seal there is provided a pressing element having a conical shape at the tip, which is inserted between two downwardly projecting joining flanges of adjacent panels so as to urge the flanges apart and thus press them tightly against opposing internal walls of the polycarbonate jointing element. It is apparent from FIG. 7 of the patent that this also urges the walls of the jointing element against the metal track thereby increasing friction between the track and the jointing element and militating against sliding of the jointing element within the metal track.

EP 1 111 153 discloses a glazing system comprising a plurality of plastic glazing panels each having at least one edge region juxtaposed with the edge region of the other panel. The juxtaposed edges have an abutment extending transversely of the plane of each glazing panel. A support structure at least partially encloses the abutments to deter separation of the glazing panels from the support structure.

US 2010/132293 discloses an internal structural mullion for a standing seam panel system. A two-piece assembly includes a main extrusion having one hooked portion and a secondary extrusion having an opposing hooked portion. A cavity is defined on the main extrusion, and the secondary extrusion includes a foot which upon insertion into the cavity forms a fulcrum about which the secondary extrusion can bend away from the main extrusion and be tightened or loosened by the tightening or loosing of a screw, as a result forming a clamp for engaging panels of the panel system with variable pressure.

US 2003/188500 discloses a panel clip assembly for use with skylight or roof panel systems and having allowance for reduced movement of panels both parallel and perpendicular to the seam formed by adjoining panels.

US 2005/102943 discloses a clip assembly for securing standing seam skylight or roofing panels to substrates and including a first clip member and a second clip member each having an upright member and an upper flange member and a lower flange member extending therefrom. A gap is formed between the upright member of the first clip member and the upright member of the second clip member and a base allows the assembly to slide.

DE 203 09 516 discloses a retainer comprising at least two polycarbonate plates forming chambers and a number of cross pieces with corresponding secure fixings.

SUMMARY OF THE INVENTION

It is therefore a broad object of the present invention to provide an assembly consisting of extruded, modular panel units and a matching joining member for constructing walls, roofs and the like, that is better adapted than hitherto-proposed arrangements for allowing thermal expansion and contraction of the panels.

In accordance with one aspect of the invention there is therefore provided an assembly having the features of claim 1 for securing a panel or two juxtaposed panels to a structure so as to allow unimpeded mutual sliding of the panel or panels relative to the structure.

BRIEF DESCRIPTION OF THE DRAWINGS

In order to understand the invention and to see how it may be carried out in practice, embodiments will now be described, by way of non-limiting example only, with reference to the accompanying drawings, in which.

DETAILED DESCRIPTION OF EMBODIMENTS

In the following description of some embodiments, identical components that appear in more than one figure or that share similar functionality will be referenced by identical reference symbols. The invention may be realized using a number of different constructions and, therefore, the functionality of the invention will first be described with reference to FIG. 1, after which different embodiments will be described with reference to the other figures.

Figure 1:
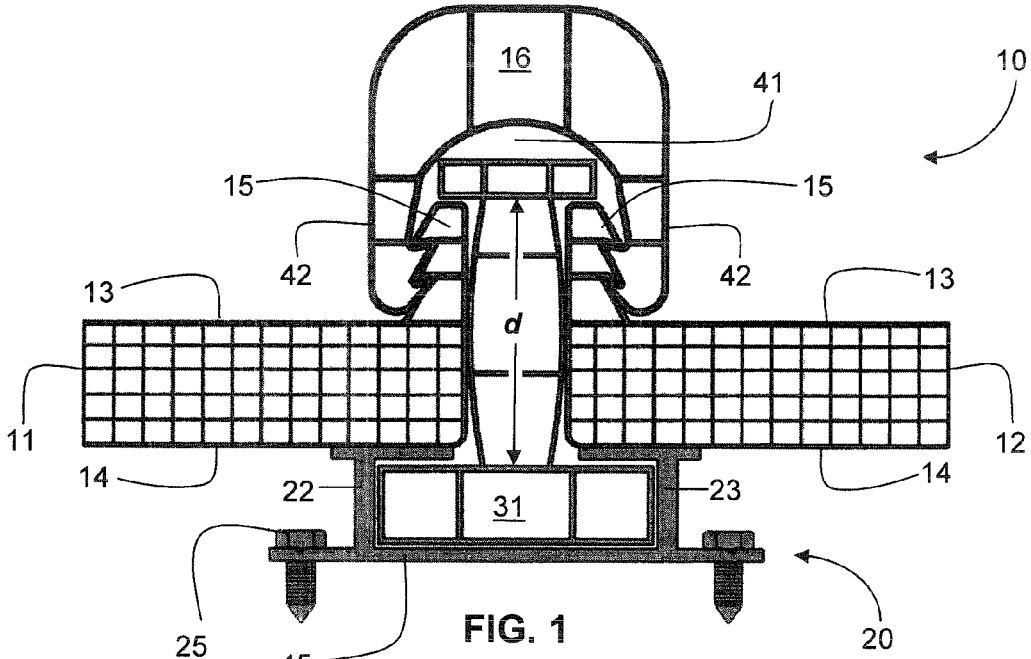
FIGS. 1 to 4 are cross-sectional views showing a panel assembly constructed according to variations of a first embodiment.

FIG. 1 shows an assembly 10 for securing two juxtaposed panels 11 and 12 to a construction element (not shown) constituting a structure so as to allow mutual sliding of the panels relative to the structure. Each of the panels 11 and 12 includes a first surface 13, an opposing second surface 14 and a joining flange 15 mounted in association with respective juxtaposed edges thereof. Thus, as shown in FIG. 1, the joining flanges 15 are located at the edges of the respective panels and are flush therewith. However, the flanges need not be flush with the edges of the panels and in some embodiments may project inwardly from the panel edges. The flanges 15 are clamped by a securing element 16 that limits lateral separation of the flanges and is formed of a material having a similar coefficient of expansion to the panel. Typically, the panels 11, 12 and the securing element 16 are formed of extruded plastic material, such as polycarbonate and in a particular application of the invention the panels at least are light transmissive.

Typically the joining flanges 15 are extruded with the panels 11, 12, such that each flange is integrally formed along an edge 17 of the panel and is formed of the same material. The edge 17 corresponds to the axis of extrusion and defines a longitudinal axis 18 of the juxtaposed panels. Since the panels 11, 12 and the securing element 16 are formed of material having similar if not identical coefficients of thermal expansion it thus follows that the joining flanges 15 and the securing element 16 expand and contract at similar rates. As a result, frictional contact between the joining flanges 15 and the securing element 16 is maintained and mutual sliding along the axis of extrusion is impeded if not altogether prevented. In hitherto-proposed constructions, this gives rise to the problems identified above owing to the direct fixation of the panels to the support structure, which prevents the panels 11, 12 and the securing element 16 from moving together without inducing longitudinal and transverse distortion of the panels.

In order to allow longitudinal displacement of the joined panels relative to the support structure, the panels are not fixed directly to the support structure but are fixed via one or more support elements 20, each configured for slidably supporting the panels relative to the support element in a direction parallel to the longitudinal axis 18 of the panels. This requirement may be met in different ways, of which some examples will now be described.

Figure 2:
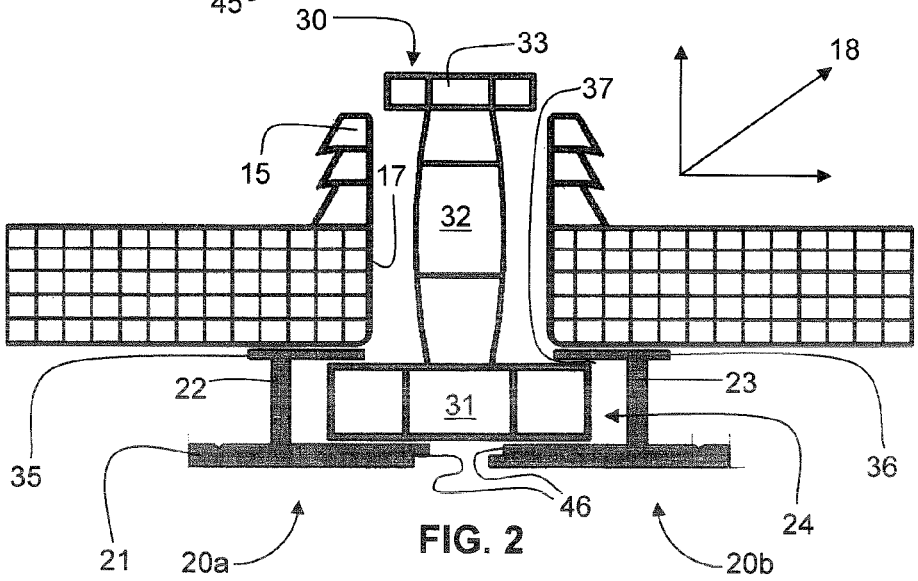

Thus, as shown in FIGS. 1 and 2, the support element 20 is in the form of a mounting bracket adapted for fixedly attaching to the structure and supporting opposing side walls 22, 23 that form a channel 24. The manner of attaching the support element 20 to the support structure is not a feature of the invention. Commonly, self-tapping screws 25 may be used since this simplifies assembly. But any other suitable form of attachment may be employed, such as regular screws, bolts, rivets, welding and so on. It should also be understood that the support element may be integral with the structure or constituted by the structure itself.

The respective flanges 15 of a pair of juxtaposed panels are retained by a generally I-shaped retaining member 30 having a base portion 31 supporting a central vertical column 32 and a planar top portion 33 that extends parallel to the base portion 31. The base portion 31 is dimensioned for sliding accommodation within the channel 24 of the support element 20, which supports the panels 11 and 12 on opposing support surfaces 35 and 36. The height, d, between the base portion 31 and the top portion 33, is slightly greater than the combined height of the panels, joining flanges and the material thickness of the support element 20 which are to be accommodated therebetween. This leaves an air gap 37 that allows for thermal expansion of the base portion 31 without obstructing the support element 20, thus maintaining the ability of the retaining member 30 to slide within the support element 20 regardless of climatic changes.

When assembled, the joining flanges 15 abut opposing surfaces of the vertical column 32 of the retaining member 30 and are secured to each other and to the retaining member 30 by the securing element 16, which is shown as a generally inverted C- or U-shaped clamping member defining an axial bore 41. Opposing side walls 42 of the securing element 16 are resiliently urged against the outer surfaces of the flanges, thereby securing the retaining member 30 and the flanges 15 within the axial bore 41. The outer surfaces of the joining flanges 15 may be tapered and provided with notches 43 e.g., saw-tooth or barb-shaped notches that engage complementary notches 44 (see FIG. 5) formed along the opposing side walls 42 of the securing element 16. Alternatively, the flanges may be tapered in a reverse direction so as to be wider at the tip than at the base, thus forming a dovetail joint with a securing element having an axial bore of complementary shape. It will thus be understood that the term "juxtaposed" does not imply necessarily that the panels are in abutting relationship, although they may be as described below with reference to FIG. 5.

The dimensions of the retaining member 30 ensure that, when assembled, the panels 11, 12 are supported on the support element 20 and the tips of the flanges 15 abut inner surfaces of the top portion 33. The upper bar of the retaining member 30 retains the panels in contact with the support structure in the event of upward force, for example by strong winds, applied to the lower surfaces of the panels. In this embodiment, the retaining member 30 thus cooperates with the securing element 16 to retain the panels 11, 12 and form a panel sub-assembly whose components are substantially locked to each other and incapable of mutual thermal expansion or contraction, while permitting thermal expansion or contraction of the panel sub-assembly relative to the support structure owing to the sliding accommodation of the retaining member 30 within the support element 20.

Furthermore, in such an arrangement, the weight of the panels 11 and 12 is borne by the support surfaces 35 and 36 of the support element 20. As is well known, the frictional force F generated by a body acting on a surface is given by:

$$F=\mu N$$

where: μ is the coefficient of friction between the object and the surface, and

N is the vertical component of force of the object.

In known structures such as described in WO 2003/149344, in addition to the weight of the panels bearing on the construction element, the retaining member acts to increase the force applied on the panels against the support structure. This significantly increases the frictional force and militates against sliding of the panels relative to the support structure.

In contrast thereto, in the present invention the only vertical force applied by the panels on the support structure is their weight, there being no additional clamping force. The coefficient of friction of plastic against metal is fairly low such that the frictional force is not too high to prevent relative sliding of the panels on the support surfaces 35 and 36 of the support element 20.

In the embodiment shown in FIG. 1, the support element 20 is a unitary construction formed of extruded aluminum and having a base unit 45 supporting the support element 20 and having toward opposing edges holes for accommodating the screws 25. FIG. 2 shows a variation where the base unit 45 is split so as to form a pair of opposing support elements 20*a*, 20*b*, whose base units may optionally have opposing recesses 46, which cooperate to form a continuous planar support surface.

Figure 3:
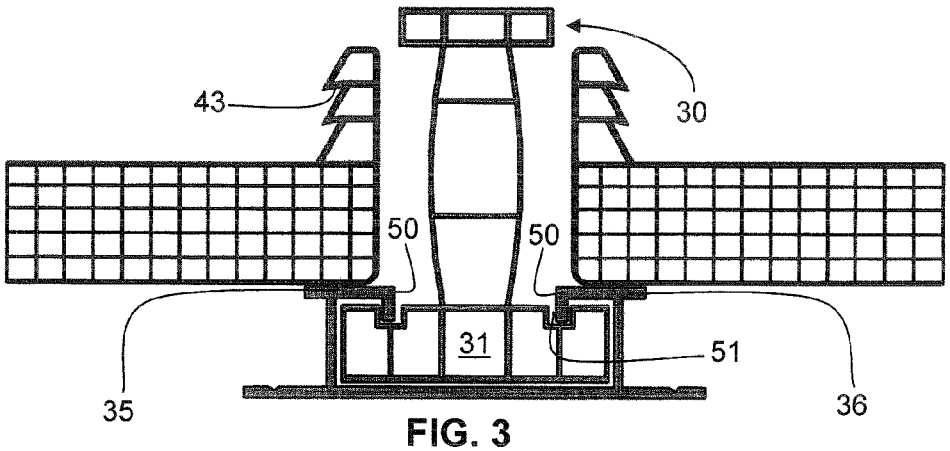
Figure 4:
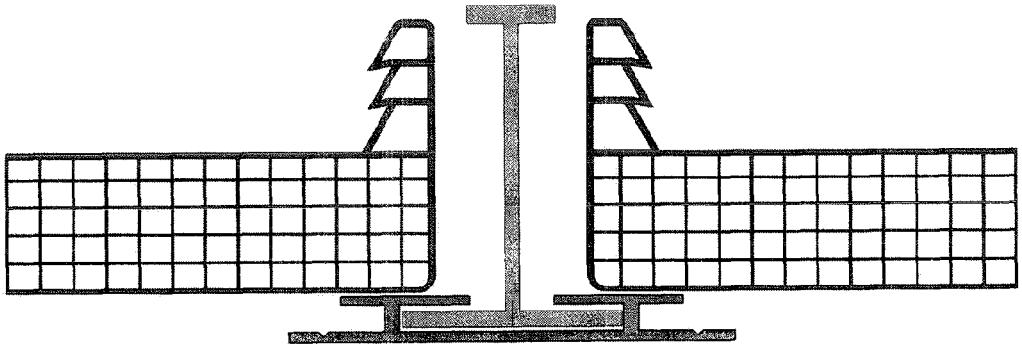

FIG. 3 shows a variation where the support surfaces 35 and 36 have downwardly depending edges 50 that slidingly engage complementary channels 51 formed in an upper surface of the base portion 31 of the retaining member 30. FIG. 4 shows another variation similar in principle to that shown in FIG. 1 and having a T-shaped retention member 30 adapted for sliding engagement in a low-profile support element 20.

Figure 5:
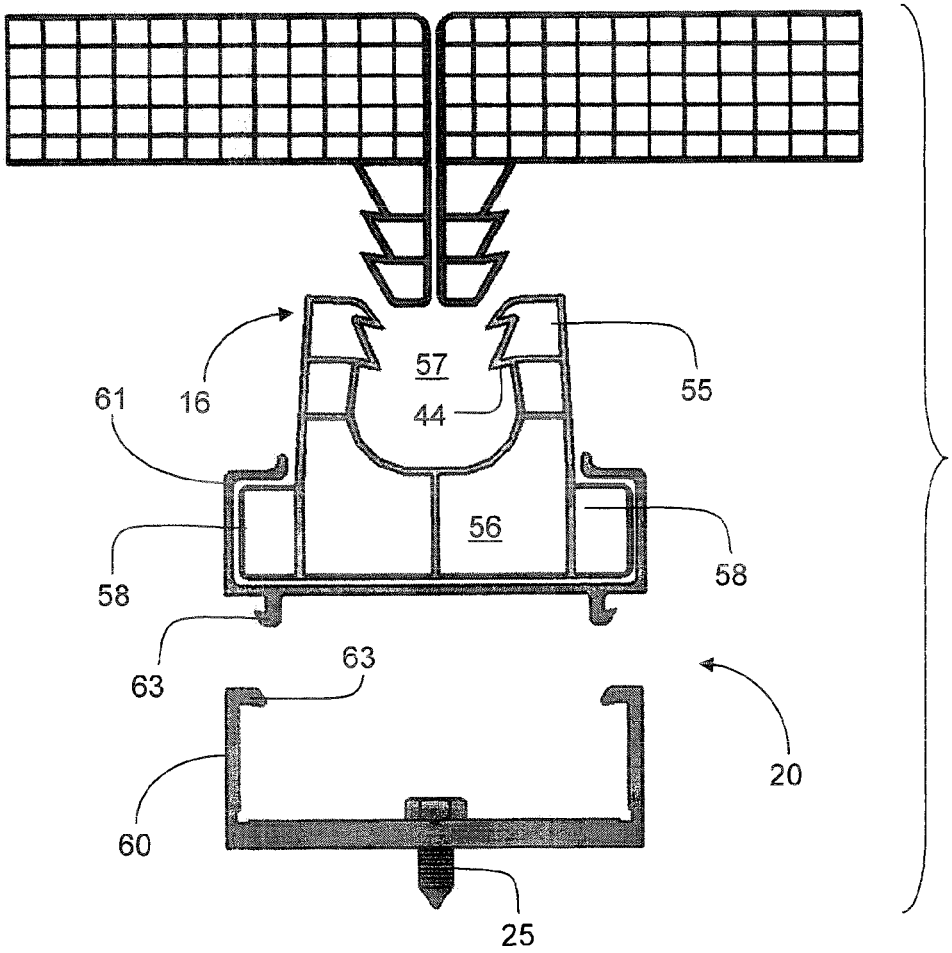
FIGS. 5 to 9 are cross-sectional views showing a panel assembly constructed according to variations of a second embodiment.

FIG. 5 shows a different embodiment that operates on a slightly different principle in that no T-shaped retaining member is required. Instead, the panels 11, 12 are inverted so that the flanges 15 face downward and are retained by the securing element 16 also in the form of a clamping member, which is adapted for sliding accommodation within the support element 20. To this end, the securing element 16 comprises a body portion 55 integrally formed with a planar base portion 56. The body portion 55 has a longitudinal bore 57 configured for resiliently accommodating therein respective joining flanges of a pair of juxtaposed panels. The base portion 56 supports outwardly protruding ears 58 on opposing sides thereof for slidable accommodation within the channel of the support element 20. In this embodiment, the securing element 16 serves as the retaining member 30 of the previous embodiment since it both retains the joining flanges 15 and slidably engages the support element 20.

Since in this embodiment, the support element retains the securing element but does not support the panels directly, the support element 20 may be simply a U-shaped bracket that is secured to the support structure and provides a channel for slidably accommodating the base portion 56 of the securing element 16. The support element 20 may be secured using screws or any other suitable fastener as described above. In the embodiment shown in FIG. 5, the support element 20 is formed of a first portion 60 and second portion 61 that interlocks with the first portion. The first portion 60 is a generally U-shaped bracket that is adapted for fixedly attaching to the structure and the second portion is a generally U-shaped channel. Thus in this embodiment, the securing element is adapted for fixedly mounting to the structure via an intermediate element. This is distinct from other embodiments where it is adapted for fixedly mounting to the structure directly. Since the screw head protrudes above the inner surface of the channel, it would foul the sliding base portion 56 of the securing element 16 if direct contact were required. The two-part construction avoids such direct contact since the base portion 56 is accommodated within the channel of the second portion 61. Both the lower and upper portions 60, 61 may be formed of extruded aluminum that interlock via complementary hooks 63 that snap fit together.

Also in this embodiment, the only vertical force applied by the panels on the support structure is their weight, there being no additional clamping force thus permitting relative sliding of the securing element 16 and attached panels within the support element 20.

Figure 6:
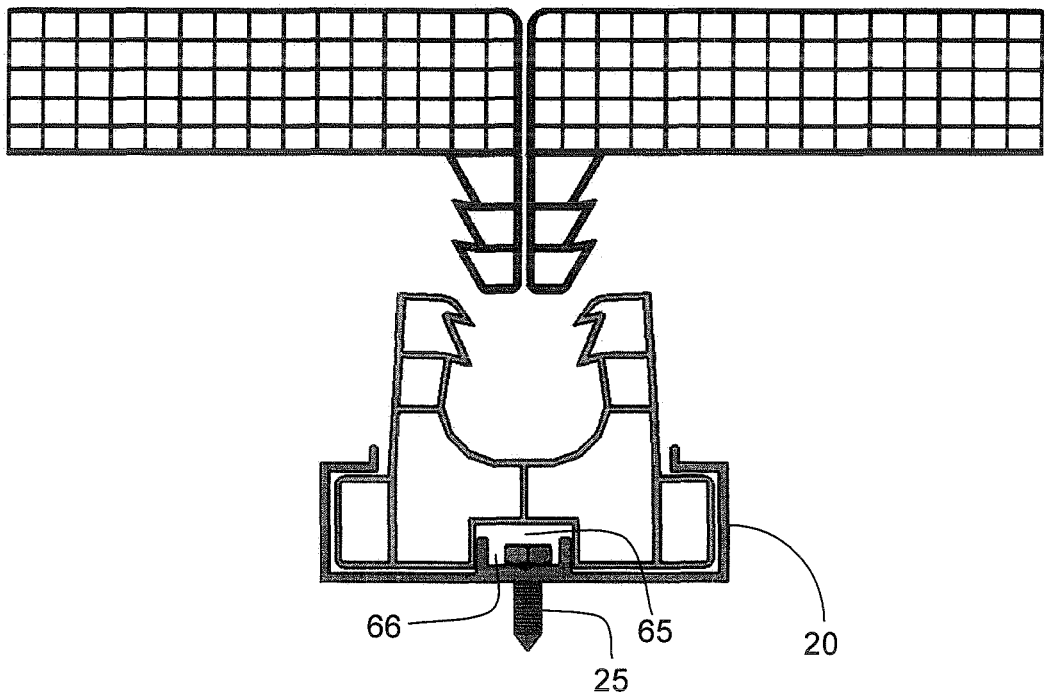

FIG. 6 shows a unitary construction where a recess 65 is formed in a lower surface of the securing element that slidably engages a complementary recessed channel 66 in the support element 20, which accommodates the screw 25, thus avoiding direct contact between the screw head and the retaining member 30.

Figure 7:
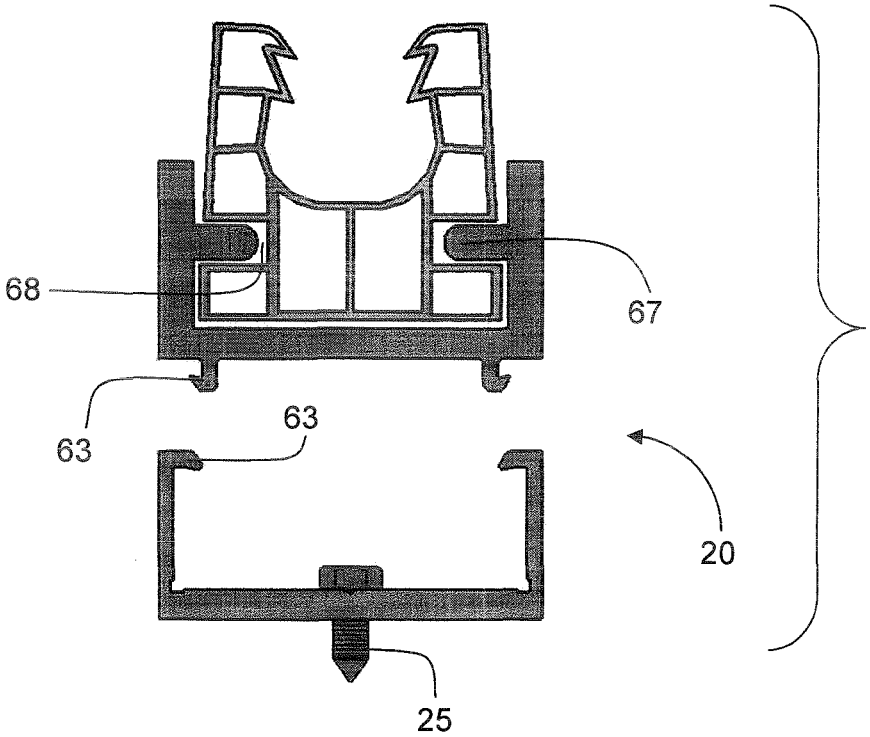

FIG. 7 shows another two-part construction similar to that shown in FIG. 5, but having inwardly projecting rails 67 that slidably engage complementary channels 68 formed in opposing side walls of the securing element 16.

Figure 8:
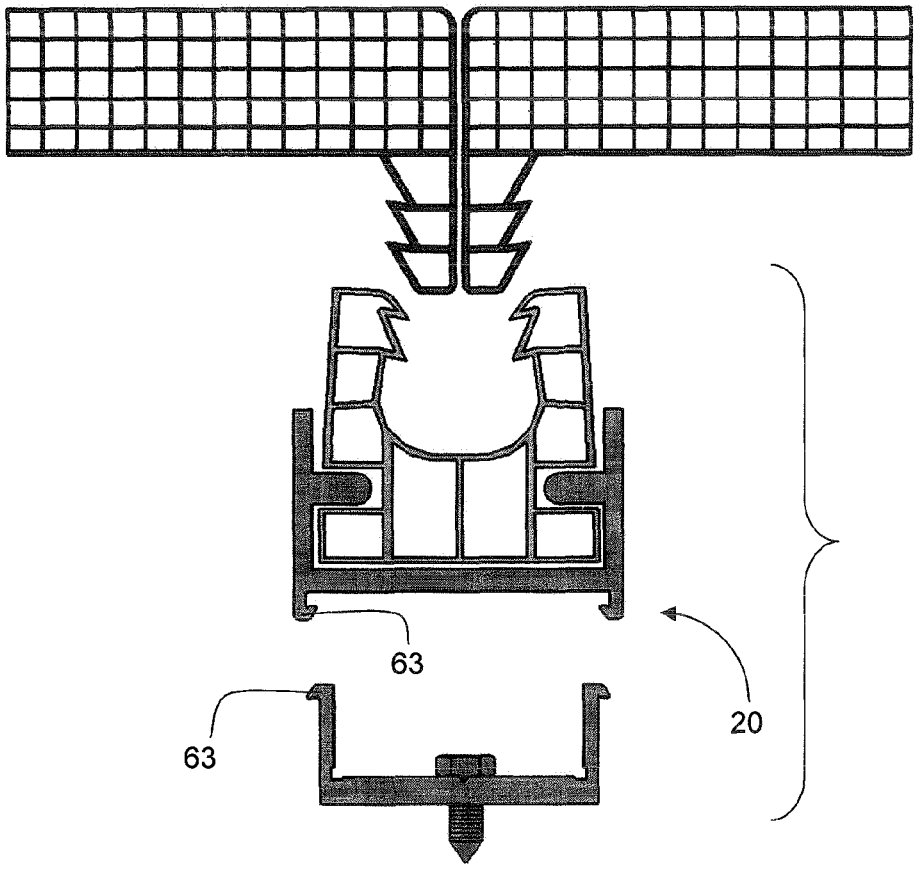

FIG. 8 shows a similar construction, the only difference being the orientation of the hooks 63.

Figure 9:
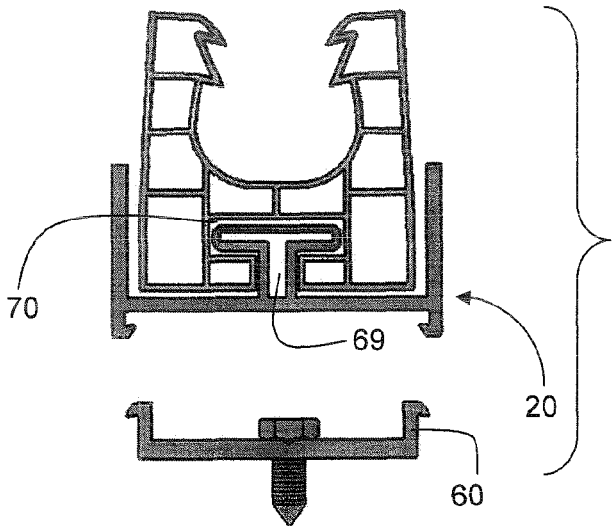

FIG. 9 shows yet another construction where the lower portion 60 of the support element 20 is of reduced profile compared with that shown in FIG. 8 and having an upwardly projecting T-shaped rail 69 on its lower inside surface for slidably engaging a complementary channel 70 formed in the lower surface of the securing element 16.

Figure 10:
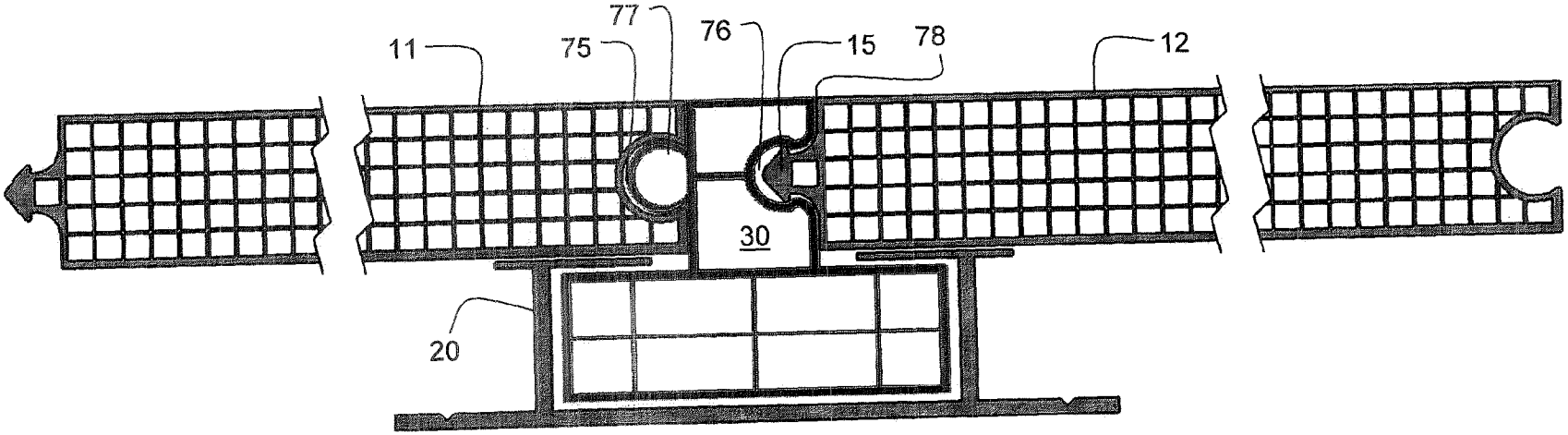
FIGS. 10 and 11 are cross-sectional views showing a panel assembly constructed according to variations of a third embodiment.
Figure 11:
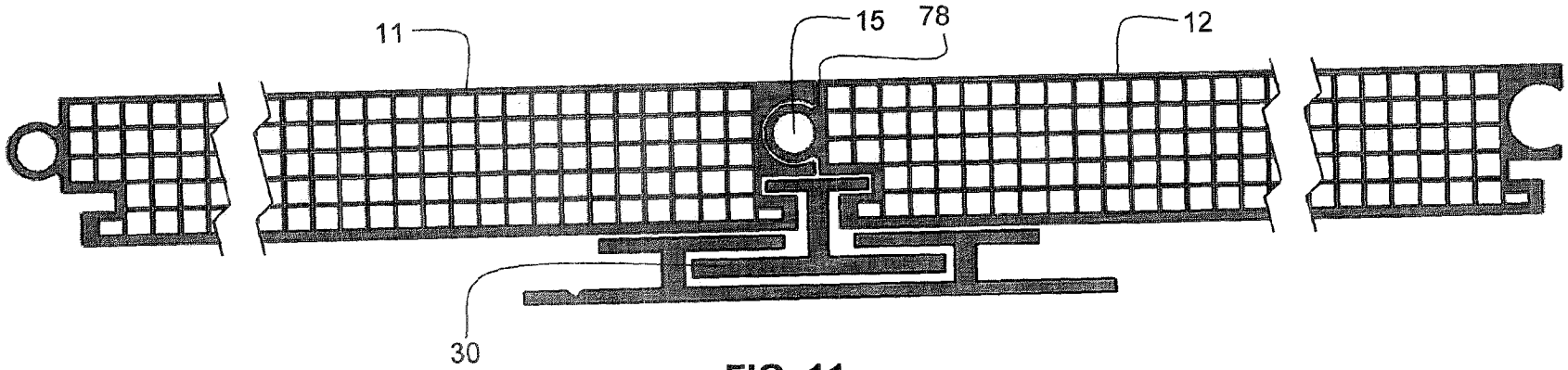

In all of the arrangements so far described, the joining flanges are perpendicular to opposing major surfaces of the panels. FIGS. 10 and 11 show alternative arrangements where each panel has a single joining flange 15 protruding from a side surface of the panel and adapted for interlocking engagement with a complementary recess 75 formed in a side surface of an adjacent juxtaposed panel. In FIG. 10 adjacent panels are interlocked via a retaining member 30 formed of a material having a similar coefficient of thermal expansion to that of the panels and having on opposite side walls a respective recess 76 and projection 77 each for engaging a respective complementary flange 15 and recess 75 on side walls of adjacent panels. The retaining member 30 is slidably supported within a support element 20 that is fixed to the structure. The retaining member 30 thus both locks the adjacent panels forming a sub-assembly comprising the two juxtaposed panels 11, 12 and the retaining member 30 as well as allowing for sliding engagement of the sub-assembly within the support element 20.

In the arrangement of FIG. 11, the retaining member 30 serves only to allow for sliding engagement of two adjoined panels 11, 12 within the support element 20. It does not lock the two panels together, this being achieved by complementary mortise and tenon-type joints that may be adapted for snap fitting of two panels or may require that they be joined by sliding the projecting male joint of one panel into the female recess of the other panel.

It should be noted that when the flanges 15 are mounted at the side of the panels 11, 12 as shown in FIGS. 10 and 11, there is formed a seam 78, which is susceptible to leakage of water into the structure. Also in the arrangement of FIGS. 5 to 9 there is an exposed seam between two juxtaposed panels. However, in this case any water seepage will collect in the longitudinal bore 57 of the securing element 16 without seeping into the structure. As opposed to this, there is no exposed seam in the arrangement shown in FIGS. 1 to 4, since the securing, element 16 covers the seam between two juxtaposed panels thereby preventing water seepage into the structure.

The panels 11, 12 are very typically used as roof structures and are therefore particularly vulnerable to water seepage, which obviously should be avoided. For this reason, the use of the securing element 16 of a type that forms a water impermeable barrier between the panels 11, 12 and the structure is preferable. Such a securing element 16 dictates that the flanges 15 protrude from one of the major surfaces 13, 14 of the panel rather than from a mating surface as shown in FIGS. 10 and 11.

Figure 12A:
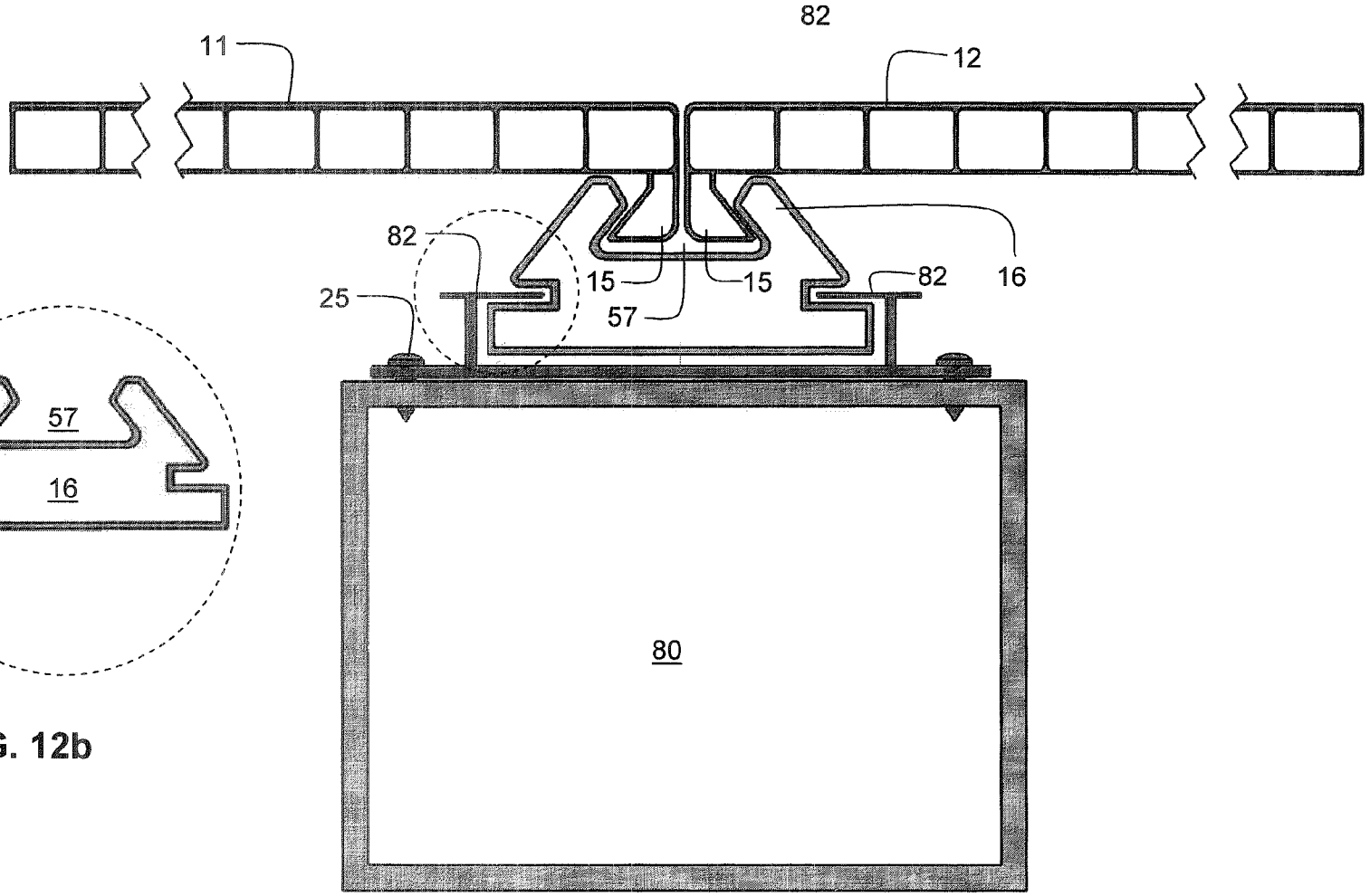
FIG. 12*a* is a cross-sectional view showing an alternative flange construction for use with any of the embodiments of FIGS. 1 to 9.
Figure 12B:
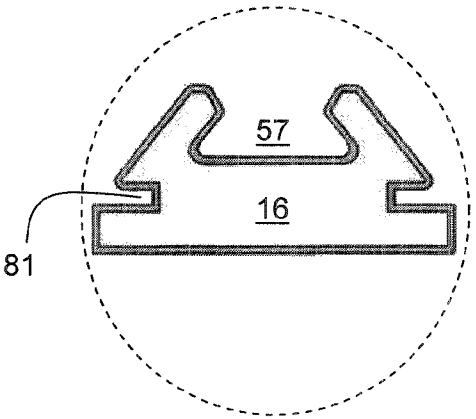
FIG. 12*b* shows a detail of an integral securing element and retaining member used in the embodiment of FIG. 12*a*.

FIG. 12*a* shows a structure 80 to which there are slidingly secured a pair of juxtaposed panels 11, 12 having tapered flanges 15 that are wider at their respective tips than at their bases. The tapered flanges 15 are secured within a securing element 16 that is formed of material having a similar coefficient of expansion to the joining flanges 15 and which has a longitudinal bore 57 of complementary shape to the joining flanges 15 so as to form a dovetail joint. The securing element 16 is provided with lateral slots 81 best seen in FIG. 12*b* that slidably accommodate respective rails 82 of a support element 20 secured to the structure 80 by means of screws 25. It will be understood that such flanges 15 may be used in any of the embodiments described above with reference to FIGS. 1 to 9 of the drawings. Also in this embodiment, the securing element 16 serves both to secure the adjoining flanges of a pair of juxtaposed panels and also to slidably retain the panels within the support element 20.

Figure 13:
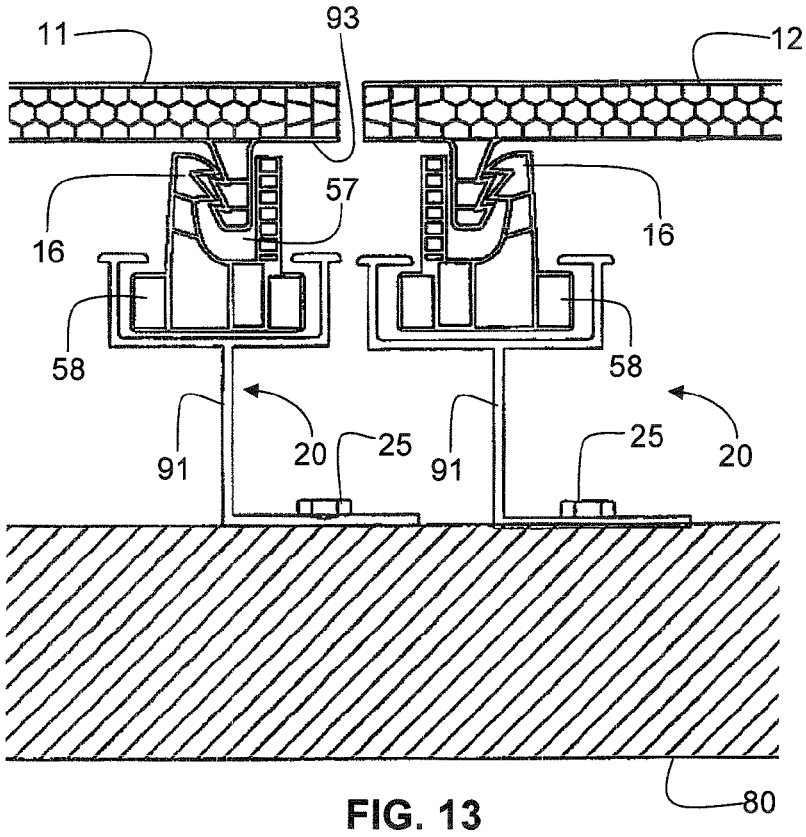
FIGS. 13 and 14 are cross-sectional views showing a panel assembly constructed according to variations of a fourth embodiment.
Figure 14:
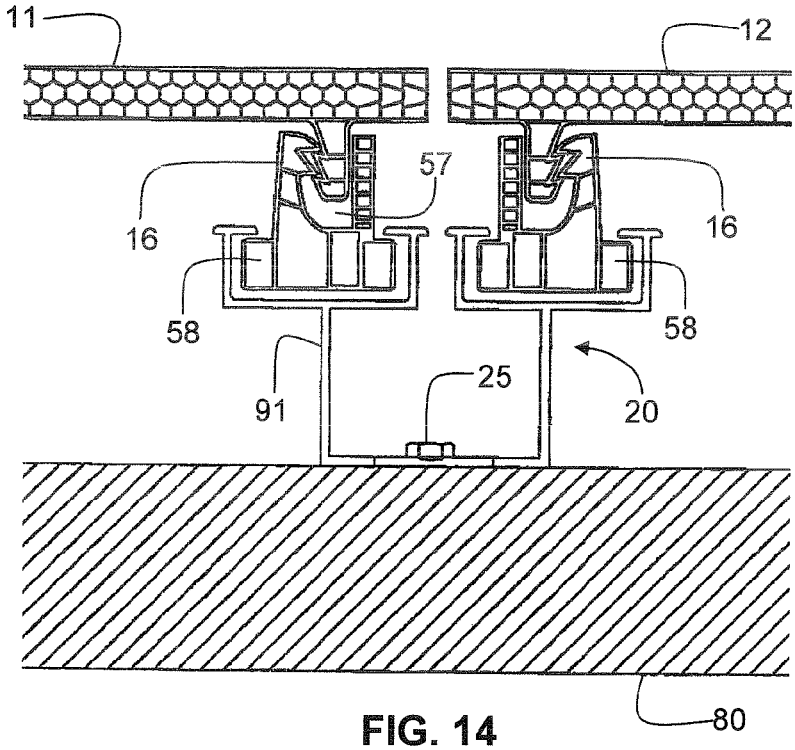

FIGS. 13 and 14 show a structure 80 to which there are slidingly secured a pair of juxtaposed panels 11, 12 having flanges 15 that may tapered so as to be wider at their respective tips than at their bases. More generally, and equally true for all the embodiments, the flanges are of complementary shape to the hollow of the securing element 16. Where the securing element 16 is provided with indents, the flanges are likewise provided with indents, although again this is not mandatory as can be seen with reference to FIGS. 10, 11 and 12 where the flanges have no indents but are still of complementary shape to the hollow of securing element 16.

Unlike the embodiments so far described where adjoining flanges of a pair of juxtaposed panels are commonly supported within a single securing element, in this embodiment a separate securing element is provided for each flange. Thus, each of the flanges 15 is secured within its respective securing element 16 that may be formed of material having a similar coefficient of expansion to the joining flange 15 and which has a longitudinal bore 57 of complementary shape to the joining flange 15. Each securing element 16 has a base supporting opposing ears 58 that are slidably mounted within corresponding channels 24 of a support element 20 secured to the structure 80 by means of screws 25. Thus, at its upper end the securing element 16 serves to secure the respective panel while at its base it also serves to retain the panel within support element 20.

Each of the support elements 20 is supported by a respective mounting bracket 91 that is fixed to the structure 80 by corresponding screws 25. In order to ensure proper abutment of the adjoining edges of the juxtaposed panels, the joining panels 15 are mounted inward of the adjoining edges so as to leave sufficient overhang 93 that allows for sufficient clearance between the two support members. In FIG. 13, the respective mounting brackets 91 of adjacent support elements 20 are spatially separated and each is separately fixed to the structure 80. Thus, during assembly, each bracket is screwed to the structure 80 by self-tapping screws 25, the securing elements 16 are then slidably mounted within the channels of the support elements 20 and the panels 11, 12 are then mounted in the respective securing elements 16.

In FIG. 14 the respective mounting brackets 91 of a pair of adjoining support elements 20 overlap and are commonly fixed to the structure 80 by screws 25. In this case, sufficient gap must be left between the respective support elements of adjoining panels to provide access to the screw 25. It is emphasized that all the figures are schematic and are not drawn to scale.

It is also reiterated that in all embodiments, self-tapping screws 25 may be used since this simplifies assembly. But any other suitable form of attachment may be employed, such as regular screws, bolts, rivets, welding and so on. Likewise, in all embodiments the support element may be integral with the structure or constituted by the structure itself.

While the drawings show constructional panels having two major surfaces defining the height of the panel, and covering sub-spaces formed therein, as known per se, it is emphasized that the present invention is also applicable to other types of similar panels, such as panels without inner sub-spaces, or panels in which the connecting flanges are within the height of the panel, etc.

It should also be emphasized that while a large number of variations of joints and support elements have been shown, it is not intended that each variation be confined to the specific embodiment in connection with which it is illustrated and described. Thus, different variations may be combined as required and all such permutations are to be embraced by the appended claims as though they were separated illustrated and described.

While in the embodiments described, the panels and adjoining flanges and the securing element are formed of polycarbonate or other plastic materials having similar temperature coefficients of expansion, the securing element 16 may be formed of metal such as aluminum having a significantly smaller coefficient of expansion than the joining flanges. This does not matter because buckling of the panels owing to longitudinal expansion is prevented by virtue of the free sliding of the panels relative to the support structure.

Likewise, it is to be understood that while the flanges are shown as tapered, this is not essential. What is important is that the flanges be secured by the securing element in a manner that ensures they both expand and contract together at similar rates of thermal expansion. Likewise, in those embodiments having a retaining member, this also should be formed of material having a similar coefficient of thermal expansion to the panels and securing element so that when the retaining member moves within the channel of the support element, the panels and securing element move with the retaining member. It is this property that ensures that the panels are able to slide freely relative to the support structure and avoids buckling or other distortion of the panels.

It will be evident to those skilled in the art that the invention is not limited to the details of the foregoing illustrated embodiments and that the present invention may be embodied in other specific forms without departing from the scope of the claims and equivalents thereof.

The invention claimed is:

1. A panel assembly comprising:

two juxtaposed panels, each of said panels including a first surface, an opposing second surface and a joining flange located in association with an edge thereof, said edge defining a longitudinal axis of the panel, said joining flanges being configured for fastening by at least one securing element, and a securing assembly for securing said two juxtaposed panels to a structure so as to allow unimpeded mutual sliding of the panels relative to said structure consequent to longitudinal expansion or contraction of the panels, said securing assembly comprising:

a support element configured for slidably supporting the two juxtaposed panels relative to the support element in a direction parallel to said longitudinal axis, said support element being adapted for fixedly attaching directly or via an intermediate element to the structure;

a retaining member adapted for retaining the respective joining flanges of the two juxtaposed panels and being mounted within the support element and configured for longitudinal sliding relative thereto; and a securing element for clamping together the respective joining flanges of the two juxtaposed panels; wherein:

the support element comprises opposing side walls that form a channel that is dimensioned to allow free sliding therein of the associated retaining member;

the retaining member and the securing element are both formed of a material having a similar coefficient of thermal expansion to the panels so that when the retaining member moves within the channel of the support element, the panels and the securing element and the retaining member move together;

each panel is fastened to the securing element without applying lateral pressure to the side walls of the support element; and the support element is formed of metal and the retaining member is formed of plastics.

2. The panel assembly according to claim 1, wherein respective coefficients of thermal expansion of the support element and the retaining member differ by a factor of at least two.

3. The panel assembly according to claim 1, wherein said support element has a lower coefficient of thermal expansion than the retaining member.

4. The panel assembly according to claim 1, wherein the support element is formed of aluminum and the retaining member is formed of polycarbonate.

5. The panel assembly according to claim 1, wherein the support element comprises a base unit adapted for fixedly attaching to the structure, and the opposing side walls of the support element, together with the base unit, form the channel that is wider than the retaining member so as to slidably accommodate the retaining member therein.

6. The panel assembly according to claim 1, wherein the support element is formed of a first portion and a second portion that interlocks with the first portion.

7. The panel assembly according to claim 6, wherein the first portion is a generally U-shaped bracket that is adapted for fixedly attaching to the structure and the second portion is a generally U-shaped channel.

8. The panel assembly according to claim 6, wherein the second portion is provided on an outer surface thereof with outwardly protruding hooks for engaging complementary hooks in the first portion.

9. The panel assembly according to claim 5, wherein:

the retaining member is generally I-shaped and comprises a planar base portion and a planar top portion interconnected by a central column, said base portion is dimensioned for slidable accommodation within the channel of the support element, each of the joining flanges has opposing first and second ends, the first end of each being attached to a corresponding one of the panels, and the second end of each being remote from the panel to which the respective first end is attached;

the support element has opposing support surfaces each for supporting thereon one of the juxtaposed panels, and the column has a height that is slightly greater than a combined height of one of the panels, a corresponding one of the joining flanges and a material thickness of a portion of the support element defining a corresponding one of the opposing support surfaces so that when the respective first surfaces of the panels are supported on the support surfaces of the support element, respective tips of the joining flanges are retained between the base portion and the top portion of the retaining member;

the securing element being configured for resiliently engaging the joining flanges so as to prevent lateral displacement of the joining flanges relative to the retaining member whereby the top portion of the retaining member retains the tips of the flanges and resists rotation thereof, thus anchoring the retaining member to the panels to form a composite assembly that is able to slide within the channel of the support element upon thermal expansion or contraction of the panels.

10. The panel assembly according to claim 1, wherein the securing element forms a water impermeable barrier between the panels and the structure.

11. The panel assembly according to claim 1, wherein the support element is integral with, or is part of the structure.

12. A panel assembly comprising:

two juxtaposed panels, each of said panels including a first surface, an opposing second surface and a joining flange located in association with an edge thereof, said edge defining a longitudinal axis of the panel, a securing assembly for securing said two juxtaposed panels to a structure so as to allow unimpeded mutual sliding of the panels relative to said structure consequent to longitudinal expansion or contraction of the panels, said securing assembly comprising:

a securing element for joining together the respective joining flanges of the two panels, a support element configured for slidably supporting the two juxtaposed panels relative to the support element in a direction parallel to said longitudinal axis, said support element being adapted for fixedly attaching directly or via an intermediate element to the structure;

the support element comprising opposing side walls that form a channel that is dimensioned to allow free sliding therein of the securing element; wherein:

the securing element is formed of a material having a similar coefficient of thermal expansion to the panels so that when the securing element moves within the channel of the support element, the panels and the securing element move together;

each panel is fastened to the securing element without applying lateral pressure to the side walls of the support element; and the support element is formed of metal and the securing element is formed of plastics.

13. The panel assembly according to claim 12, wherein:

the securing element comprises a body portion integrally formed with a planar base portion, said body portion has a longitudinal bore configured for resiliently accommodating therein the respective joining flanges of the juxtaposed panels, and said base portion comprises outwardly protruding ears on opposing sides thereof for slidable accommodation within the channel of the support element.

14. The panel assembly according to claim 12, wherein the support element is formed of a first portion and a second portion that interlocks with the first portion.

15. The panel assembly according to claim 14, wherein the first portion is a generally U-shaped bracket that is adapted for fixedly attaching to the structure and the second portion is a generally U-shaped channel.

16. The panel assembly according to claim 14, wherein the second portion is provided on an outer surface thereof with outwardly protruding hooks for engaging complementary hooks in the first portion.

17. The panel assembly according to claim 12, wherein the securing element forms a water impermeable barrier between the panels and the structure.

18. The panel assembly according to claim 12, wherein the support element is integral with, or is part of, the structure.

19. A panel assembly comprising:

two juxtaposed panels each of said panels including a first surface and an opposing second surface, a first one of the panels having a joining flange protruding out of an end surface thereof, and a second one of the panels having a recess in an end surface thereof, a securing assembly for securing said two juxtaposed panels to a structure so as to allow unimpeded mutual sliding of the panels relative to said structure consequent to longitudinal expansion or contraction of the panels, said securing assembly comprising:

a retaining member supported by the pair of juxtaposed panels, a support element configured for slidably supporting the retaining member together with the panels relative to the respective support element in a direction that permits longitudinal expansion or contraction of the panels, wherein:

the support element is adapted for fixedly attaching directly or via an intermediate element to the structure, and the support element comprises opposing side walls that form a channel that is dimensioned to allow free sliding therein of the retaining member;

the retaining member is formed of a material having a similar coefficient of thermal expansion to the panels so that when the retaining member moves within the channel of the support element, the panels and the retaining member move together;

each panel is supported by the retaining member without applying lateral pressure to the side walls of the support element; and the support element is formed of metal and the retaining member is formed of plastics.

20. The panel assembly according to claim 19, wherein respective coefficients of thermal expansion of the support element and the retaining element differ by a factor of at least two.

21. The panel assembly according to claim 19, wherein said support element has a lower coefficient of thermal expansion than the retaining member.

22. The panel assembly according to claim 19, wherein the support element is formed of aluminum and the retaining member is formed of polycarbonate.

23. The panel assembly according to claim 19, wherein the support element comprises a base unit adapted for fixedly attaching to the structure, and the support element further comprises opposing side walls, that together with the base unit form a channel that is wider than the retaining member so as to slidably accommodate the retaining member therein.

24. The panel assembly according to claim 19, wherein:

the retaining member is generally I-shaped and comprises a planar base portion and a planar top portion interconnected by a central column, said base portion is dimensioned for slidable accommodation within the channel of the support element, and the support element has opposing support surfaces each for supporting thereon one of the juxtaposed panels.

25. A panel assembly comprising:

two juxtaposed panels, each of said panels including a first surface, an opposing second surface and a joining flange located in association with an edge thereof and being mounted inward from the adjoining edge so as to leave sufficient overhang for the installation of a respective one of a pair of support elements, a securing assembly for securing said two juxtaposed panels to a structure so as to allow unimpeded mutual sliding of the panels relative to said structure consequent to longitudinal expansion or contraction of the panels, said securing assembly comprising:

a pair of securing elements each for clamping a respective one of the joining flanges; and for each securing element, there is a respective one of the support elements configured for slidably supporting an associated one of the securing elements together with a respective one of the panels relative to the respective one of the support elements in a direction that permits longitudinal expansion or contraction of the panels, wherein:

each support element is adapted for fixedly attaching to the structure and comprises opposing side walls that form a channel that is dimensioned to allow free sliding therein of the associated securing element; wherein:

each securing element is formed of a material having a similar coefficient of thermal expansion to the panels so that when each securing element moves within the channel of the respective one of the support elements, the panels and the securing elements move together; and each panel is fastened to the respective one of the securing elements without applying lateral pressure to the side walls of the respective one of the support elements.

26. The panel assembly according to claim 25, wherein respective coefficients of thermal expansion of the support element and the securing element associated with each of the two panels differ by a factor of at least two.

27. The panel assembly according to claim 26, wherein the support element for each of the two panels has a lower coefficient of thermal expansion than the associated securing element in each of said two sets.

28. The panel assembly according to claim 25, wherein each support element is formed of aluminum and each securing element is formed of polycarbonate.

29. The panel assembly according to claim 25, wherein each support element comprises a base unit adapted for fixedly attaching to the structure and supporting opposing side walls that together with the base unit form a channel that is wider than the securing element so as to slidably accommodate the securing element therein.

* * * * *